United States Patent [19]

Filter et al.

[11] 4,253,985

[45] Mar. 3, 1981

[54] PROCESS FOR HANDLING AND SOLIDIFICATION OF RADIOACTIVE WASTES FROM PRESSURIZED WATER REACTORS

[75] Inventors: Harold E. Filter, Midland; Keith Roberson, Freeland, both of Mich.

[73] Assignee: The Dow Chemical Company, Midland, Mich.

[21] Appl. No.: 4,099

[22] Filed: Jan. 17, 1979

[51] Int. Cl.[3] ..... G21F 9/16; G21F 9/20

[52] U.S. Cl. ..... 252/301.1 W; 260/37 EP; 260/40 R

[58] Field of Search ..... 252/301.1 W; 423/279, 423/280, 282; 260/37 EP, 40 R

[56] References Cited

U.S. PATENT DOCUMENTS

| | | | |
|---|---|---|---|
| 2,998,310 | 8/1961 | O'Brien et al. | 423/280 |
| 3,507,801 | 4/1970 | Kausz et al. | 252/301.1 W |
| 3,988,258 | 10/1976 | Curtiss et al. | 252/301.1 W |
| 4,077,901 | 3/1978 | Arnold et al. | 252/301.1 W |

FOREIGN PATENT DOCUMENTS

| | | | |
|---|---|---|---|
| 49-104100 | 10/1974 | Japan | 252/301.1 W |

OTHER PUBLICATIONS

Subramanian et al, "Solidification of Low Level Radioactive Wastes", *Wash. State U. Coll. Eng. Circ.* 50, (1974).

Giesler et al., "Treatment of Boric Acid Containing Waste Water . . . ", Chem. Abstracts, 79: 45369z (1973).

*Primary Examiner*—Deborah L. Kyle

[57] ABSTRACT

Borate-containing radioactive waste waters are treated by the addition of an alkali metal hydroxide and/or ammonium hydroxide (including non-detrimentally substituted ammonium hydroxides) in an amount effective to prevent precipitation of the borates at temperatures at or near the ambient temperature range, herein meaning about 60° F.-90° F. The invention is ideally practiced in conjunction with the disposal of such wastes by encapsulation wherein an encapsulating binder material or monomer is polymerized in situ with the waste under exothermic reaction conditions.

8 Claims, No Drawings

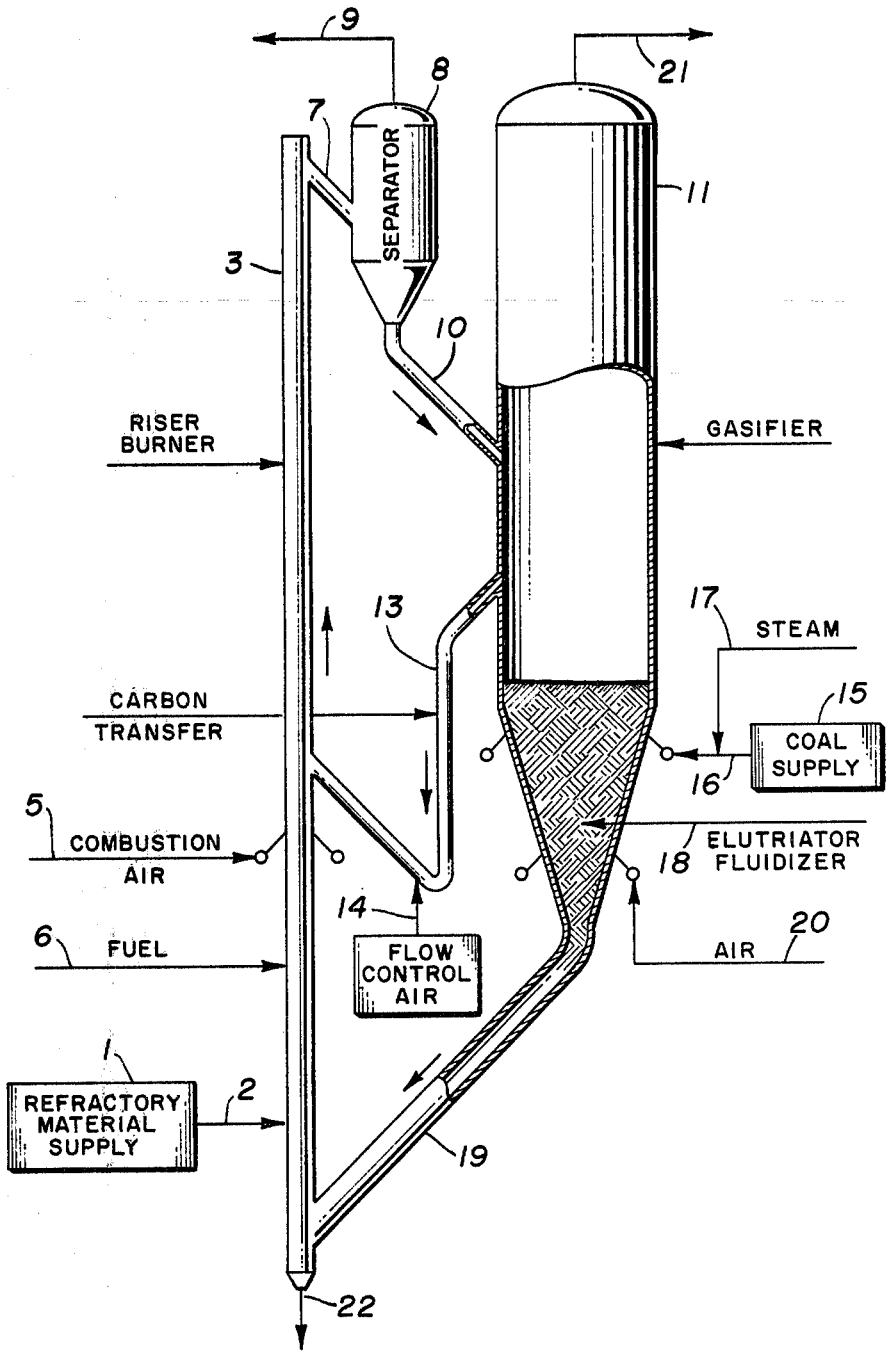
9
8
21
7
SEPARATOR
11
3
10
RISER BURNER
GASIFIER
13
17
STEAM
CARBON TRANSFER
15
COAL SUPPLY
16
5
COMBUSTION AIR
ELUTRIATOR FLUIDIZER
18
14
6
FUEL
FLOW CONTROL AIR
AIR
20
1
REFRACTORY MATERIAL SUPPLY
2
19
22

PROCESS FOR HANDLING AND SOLIDIFICATION OF RADIOACTIVE WASTES FROM PRESSURIZED WATER REACTORS

FIELD OF THE INVENTION

The invention relate to the treatment and disposal of high borate content (about 5–50 weight percent borates) radioactive waste waters such as characteristically generated by pressurized water reactor (PWR) nuclear power plants. More specifically, the invention relates to the treatment of such wastes in order to convert the same to a form more suitable for handling and disposal preferably by encapsulation in solid binder materials by the technique of combining the waste with the binder in liquid forms, and thereafter polymerizing in situ to prepare a solid binder/waste matrix.

BACKGROUND OF THE INVENTION

In processes for disposing of high borate content aqueous radioactive waste solutions or evaporator bottoms, such as generated in the operation of PWR nuclear power plants, it would be advantageous if the waste could be first cooled to near ambient temperatures. Preferred disposal methods, for example, utilize polymerization in situ methods for forming a leach resistant binder or solid matrix in which the radioactive waste is dispersed. Since such reactions are characteristically exothermic, excessive temperatures (100° C.) can result which can pressurize the cured structure of the binder during the manufacture of the binder/waste matrix. A cooling step would thus be especially desirable.

Present solidification procedures, however, require the inapposite step of heating the waste to temperatures of between about 140° F.–180° F. and thus close to boiling water temperatutes prior to the onset of solidification procedures. Such a heating step is the currently practiced means by which precipitation is controlled effectively.

As a further aspect, the above-defined high borate content radioactive wastes are also highly susceptible to plugging and fouling of lines and vessels, such as the evaporation and heat exchange units, whenever a temperature control failure occurs in a part of the extensive circulation system through which such wastes are routed. Since resulting necessary repairs require exposure of workers to radiation hazards, advantages could be realized broadly if precipitation of solids in the waste solution could be satisfactorily solved by means other than controlling and maintaining critical operating temperatures at all points in the waste stream circulation system.

DETAILED DESCRIPTION OF THE INVENTION

The invention is a process for treating radioactive acidic, aqueous wastes containing high temperature-dependent, precipitatable borates (precipitation occurring at temperatures below about 120° F.–140° F.) to render such borates soluble in the waste solution whenever the solution is cooled to around ambient temperatures, herein defined as meaning the range of from about 60° F.–90° F.

A primary aspect of the invention relates to the addition of an alkali metal hydroxide or ammonium hydroxide (including non-detrimentally substituted ammonium hydroxides) to the circulation system by which such wastes are routed from the reactor to heat exchange means and thereafter to cleanup means such as an evaporator to be deionized and returned for re-use in cooling the reactor. An effective amount of such base or bases is added to render the temperature dependent, precipitatable borates of such waste solution soluble in the ambient temperature range.

A second primary aspect of the invention relates to the disposal of the bottoms, i.e., evaporator bottoms or other bottoms generated in the cleanup of the reactor cooling waters prior to recirculation to the reactor. The method, as practiced with regard to this special application, utilizes the combined and advantageous steps of adding to the waste solution one or more bases of the defined group in an amount effective to produce soluble borates in the ambient temperature range, and cooling such wastes to a temperature within the ambient temperature range, prior to or in conjunction with admixing of the waste in a liquid binder material, which binder material is solidifiable for producing a solid binder/waste matrix. The order of such steps is not necessarily critical, since as the Examples below demonstrate that the additives specified herein can effectively return the precipitate to solution, such as where precipitation has occurred prematurely.

High borate content radioactive wastes, as are particularly the subject of the invention, characteristically contain from between about 5 to about 12 weight percent borate solids content. Extremely high borate content waste solutions as contemplated within the broad definition of the invention, however, may contain as much as about 50 percent by weight borate solids.

The effective amount of additives to treat such waste solutions in any given case is determined experimentally based on a given additive, and specific waste solution. Depending on the exact content of any such given waste solution, the effective amount necessary to produce water-soluble borate salts within the defined ambient temperature range can vary.

In addition, the effective amount, in any given application, is determined within operating limits based on an inoperative range occurring on each side of the effective range or amount. In such cases where the inoperative range has been reached by adding too much of one or more of the above-defined group of bases, addition of a strong acid may be utilized to neutralize the excess salt, and thus return the system to the effective and operative range.

Most preferred among the additive group specified are sodium, lithium, potassium and ammonium hydroxide. Substituted ammonium hydroxides such as lower alkyl and hydroxy substituted ammonium may be utilized, provided the substitution is non-detrimental to the effectiveness of the hydroxide to form borate salt(s) which are water-soluble in the ambient temperature range.

In respect to the aspects of converting the waste to a solid, various binders such as cement, urea-formaldehyde, vinyl ester and polyester solidification binder systems are known, and may be utilized compatibly in conjunction with the teachings of the present invention. Various of such known processes are pH sensitive, and thus may require a pH modifier in order to effect curing or polymerization in any given system. Most preferred solidification methods for use in conjunction with the waste stream treatment method hereof are the known thermoset vinyl ester and vinyl ester/polyester resin systems, such as described in detail in U.S. Pat. No. 4,077,901, the teachings of which are fully incorporated herein by reference.

EXAMPLE 1

Preparatory to treatment on a larger scale, a laboratory analysis is performed on high borate content radioactive evaporator bottoms, using a 350 ml sample, of about 2.5 pH, and which upon cooling to ambient temperature forms a cloudy blue solution estimated to contain about 5–8 weight percent white precipitate. The solution is successfully treated with 2.5 ml of a 50 weight percent aqueous sodium hydroxide additive to completely solubilize the sample. 150 ml Of the treated sample, having a pH of about 7.0, is subsequently solidified with the following ingredients: 100 ml Of a fluid thermosettable vinyl ester resin which is made by reacting 32.6 parts of the diglycidyl ether of bisphenol A extended with 8.7 parts of bisphenol A then reacted with 1.2 parts maleic anhydride and 7.5 parts methacrylic acid, the resin dissolved in 50 parts styrene; 2.5 ml of 40 percent benzoyl peroxide emulsified in dibutyl phthalate; 0.2 ml of N,N-dimethyl-p-toluidine.

The vinyl ester resin and benzoyl peroxide are measured into a large paper cup and mixed thoroughly with an electric stirrer. The radioactive waste sample is slowly added to the blend with the stirrer at high speed to assure good emulsification. The dimethyl toluidine is added to the emulsion and mixed thoroughly for 30 to 60 seconds. The stirrer is removed and gelling is observed in 4.5 minutes. A homogeneous rock-hard solid is achieved in about 1 hour.

EXAMPLE 2

30 Gallon quantities of radioactive waste of the same origin as Example 1, and comprising evaporator bottoms of an operating PWR nuclear plant, are placed in 55-gallon steel drums at 250° F. 800 ml Of 50 weight percent aqueous sodium hydroxide is added to each drum, and the waste is permitted to cool to ambient temperature (68° F.–70° F.). In each case a clear blue solution is observed showing no evidence of precipitation. 30 Gallons of vinyl ester resin and 1900 ml of the emulsion, each as specified in Example 1, are mixed together in a 55 gallon drum, and 30 gallons of the treated waste are slowly pumped into the mixture, and agitated with a high speed air stirrer. 140 ml Of dimethyl toluidine is added and mixed thoroughly for 30–60 seconds. Successful rock-hard solidification is achieved in approximately 1 hour.

EXAMPLE 3

Laboratory analysis and treatment is performed on a radioactive, high borate content PWR radioactive waste solution of different origin, pH of about 6.6–6.8, and appearing dark brown in color with approximately 5–10 weight percent of a lgiht brown precipitate forming upon cooling. 2.8 ml Of 50 weight percent aqueous sodium hydroxide is added to 150 ml samples of the cooled waste to achieve a clear light brown treated waste solution of between about 8.2–8.5 pH having no observable precipitate. The treated waste is subsequently solidified successfully using the procedure and reactants of Example 1.

EXAMPLE 4

On a larger plant scale, 4 gallons of 50 weight percent aqueous sodium hydroxide are added to 275 gallons of the above waste (Example 3) in a 50 $ft^3$ cylindrical steel tank. Following the step of cooling the waste solution to ambient temperature, air is bubbled through the tank using a ¾-inch Tygon tube for approximately 16 hours. Total solution of the precipitate formed upon cooling is achieved resulting in a clear, light brown solution with a measured pH of about 8.2–8.5.

30 Gallons of the treated waste are subsequently added to a mixture of 20 gallons of vinyl ester resin and 1675 ml of benzoyl peroxide emulsion, using the procedure as described in Example 2. 180 ml Of dimethyl toluidine is added to the emulsion. The emulsion gells in approximately 12 minutes and is rock-hard in 1 hour.

What is claimed is:

1. A method of solidifying evaporator bottoms or other wastes generated in the cleanup of nuclear reactor cooling waters prior to recirculation to the reactor, said wastes comprising aqueous radioactive solutions containing borates which are precipitatable in the ambient temperature range, said method comprising the combined steps of treating the aqueous wastes by admixing therewith one or more of the group of alkali metal hydroxides, ammonium hydroxide, and non-detrimentally substituted ammonium hydroxides in an amount effective to produce soluble borate salts in the ambient temperature range, bringing the aqueous wastes to a temperature within the ambient temperature range, admixing the wastes with a polymerizable liquid binder material, thereafter polymerizing said liquid binder in situ with such wastes admixed therewith to prepare a solid binder/waste matrix.

2. The method of claim 1 wherein said waste solution contains on a solids basis from about 5 to about 50 weight percent borates.

3. The method of claim 2 wherein said additive comprises a hydroxide selected from the group consisting of sodium, lithium, potassium, ammonium or mixtures thereof.

4. The method of claim 2 wherein said additive comprises a lower alkyl or hydroxy substituted ammonium hydroxide.

5. The method of claim 1 wherein said binder comprises a liquid thermosettable vinyl ester resin.

6. The method of claim 5 wherein said additive comprises sodium hydroxide.

7. The method of claim 6 wherein said waste solution contains on a solids basis, from about 5 to about 12 weight percent borates.

8. The method of claim 7 wherein said waste solution is the evaporator bottoms of a PWR nuclear power reactor.

* * * * *

UNITED STATES PATENT AND TRADEMARK OFFICE

CERTIFICATE OF CORRECTION

PATENT NO. : 4,253,985

DATED : March 3, 1981

INVENTOR(S) : Harold E. Filter and Keith Roberson

It is certified that error appears in the above—identified patent and that said Letters Patent is hereby corrected as shown below:

Delete the Sheet of Drawing

Col. 1, line 7, delete the word "relate" and insert --relates--.

Col. 1, line 37, delete "temperatutes" and insert --temperatures--.

Col. 3, line 57, delete "lgiht" and insert --light--.

Signed and Sealed this

*Twenty-second* Day of *September 1981*

[SEAL]

*Attest:*

GERALD J. MOSSINGHOFF

*Attesting Officer*

*Commissioner of Patents and Trademarks*

Disclaimer and Dedication 4,253,985.—*Harold E. Filter*, Midland; *Keith Roberson*, Freeland, both of Mich. PROCESS FOR HANDLING AND SOLIDIFICATION OF RADIOACTIVE WASTES FROM PRESSURIZED WATER REACTORS. Patent dated Mar. 3, 1981. Disclaimer and Dedication filed Dec. 18, 1989, by the assignee, The Dow Chemical Company.

Hereby disclaims and dedicates to the Public all claims of said patent.

[*Official Gazette April 10, 1990* ]